US012037169B2

(12) United States Patent
Lynn

(10) Patent No.: US 12,037,169 B2
(45) **Date of Patent: *Jul. 16, 2024**

(54) CHILD RESISTANT CONTAINER WITH ACTIVATOR BUTTONS

(71) Applicant: Sonoco Development, Inc., Hartsville, SC (US)

(72) Inventor: Robert Timothy Lynn, Marengo, IL (US)

(73) Assignee: Sonoco Development, Inc., Hartsville, SC (US)

( * ) Notice: Subject to any disclaimer, the term of this patent is extended or adjusted under 35 U.S.C. 154(b) by 85 days.

This patent is subject to a terminal disclaimer.

(21) Appl. No.: 17/979,544

(22) Filed: Nov. 2, 2022

(65) Prior Publication Data

US 2023/0047954 A1 Feb. 16, 2023

Related U.S. Application Data

(63) Continuation of application No. 17/172,813, filed on Feb. 10, 2021, now Pat. No. 11,524,824.

(60) Provisional application No. 62/972,373, filed on Feb. 10, 2020.

(51) Int. Cl.

| | |
|---|---|
| ***B65D 50/04*** | (2006.01) |
| ***B65D 5/38*** | (2006.01) |
| ***B65D 77/04*** | (2006.01) |

(52) U.S. Cl.

CPC ..... *B65D 50/046* (2013.01); *B65D 5/38* (2013.01); *B65D 77/0433* (2013.01); *B65D 2215/02* (2013.01)

(58) Field of Classification Search

CPC ..... B65D 5/5088; B65D 7/10; B65D 9/08; B65D 11/12; B65D 77/0433; B65D 2215/02; B65D 50/046

See application file for complete search history.

(56) References Cited

U.S. PATENT DOCUMENTS

| | | | | |
|---|---|---|---|---|
| 7,757,843 | B2 | 7/2010 | Katsis | |
| 8,499,936 | B2 * | 8/2013 | Albrecht | B65D 83/0463 206/531 |
| 2012/0261275 | A1 * | 10/2012 | Intini | B65D 75/327 206/532 |
| 2015/0157109 | A1 * | 6/2015 | Provost | A45D 27/22 220/528 |
| 2019/0084715 | A1 * | 3/2019 | Whitehurst | B65D 79/00 |
| 2020/0087020 | A1 | 3/2020 | Tsai et al. | |
| 2022/0063877 | A1 * | 3/2022 | Forenza | B65D 5/38 |

* cited by examiner

*Primary Examiner* — Mollie Impink

(74) *Attorney, Agent, or Firm* — von Briesen & Roper, s.c.

(57) ABSTRACT

A child resistant container having a two-point or three-point activator system is provided. The container comprises a tray, a carton or other enclosure and a plurality of buttons that must be simultaneously depressed or otherwise activated to remove the tray out of the carton. The buttons are positioned so as to require an adult hand to operate.

18 Claims, 4 Drawing Sheets

CHILD RESISTANT CONTAINER WITH ACTIVATOR BUTTONS

CROSS REFERENCE TO RELATED APPLICATION

This application is a continuation of U.S. application Ser. No. 17/172,813, filed Feb. 10, 2021, now pending, which claims the benefit of U.S. Provisional Application No. 62/972,373, filed Feb. 10, 2020. U.S. Provisional Application No. 62/972,373 and U.S. application Ser. No. 17/172,813 are incorporated herein by reference in their entirety to provide continuity of disclosure.

BACKGROUND

Field of the Invention

This patent relates to a child resistant container. More particularly, this patent relates to a child resistant container having a three-point activator system.

Description of the Related Art

There are numerous child resistant packages on the market, some that are more effective than others. The present disclosure relates to a novel child resistant container having a three-point activator system.

SUMMARY OF THE INVENTION

The present disclosure relates to a novel child resistant container having a three-point activator system. The container comprises a tray, a carton or other enclosure and a three buttons that must be simultaneously depressed to slide the tray out of the carton. The buttons are positioned so as to require an adult hand to operate.

THE DRAWINGS

DETAILED DESCRIPTION OF THE INVENTION

Figure 1:
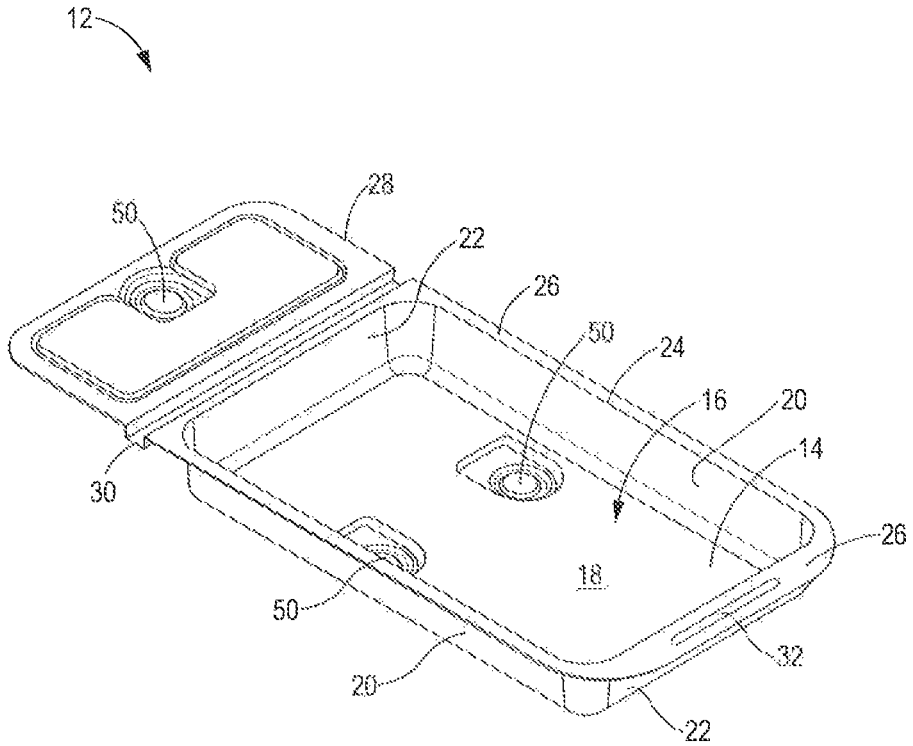
FIG. 1 is a perspective view of a tray used as a component of a container according to the present disclosure.
Figure 2:
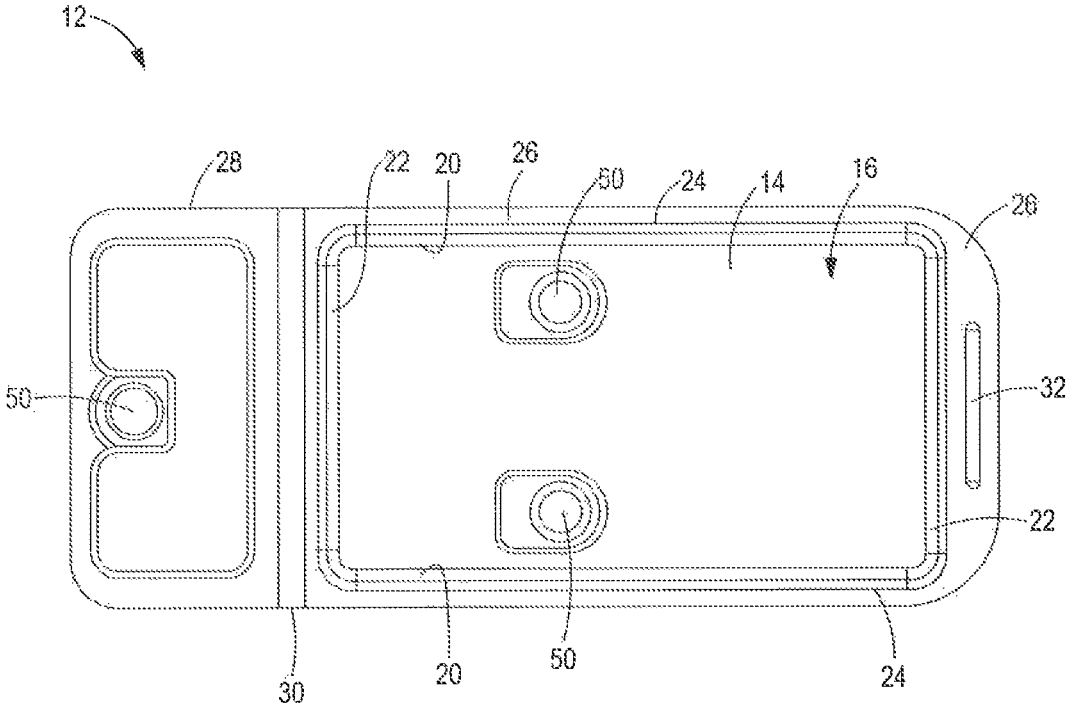
FIG. 2 is top view of the tray of FIG. 1.
Figure 3:
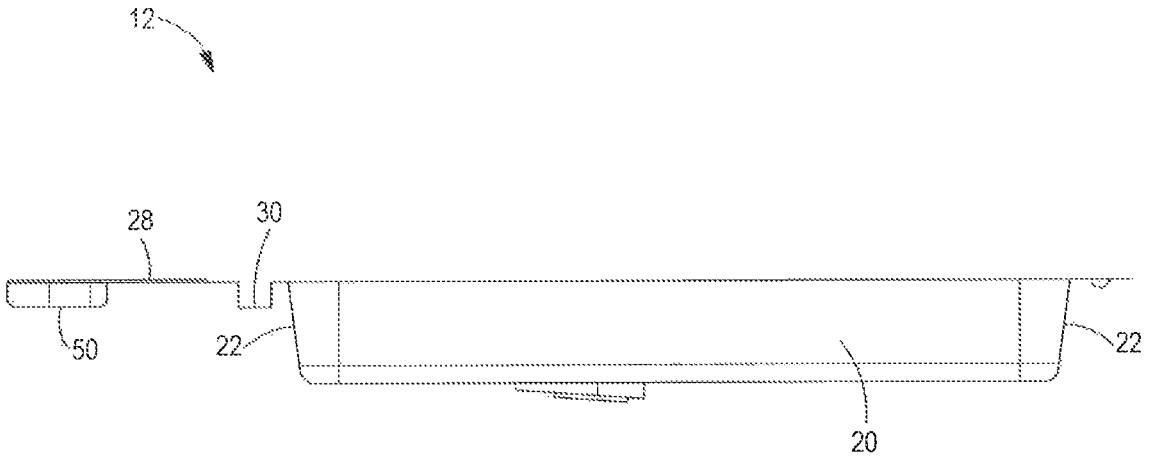
FIG. 3 is a side elevational view of the tray of FIG. 1.
Figure 4:
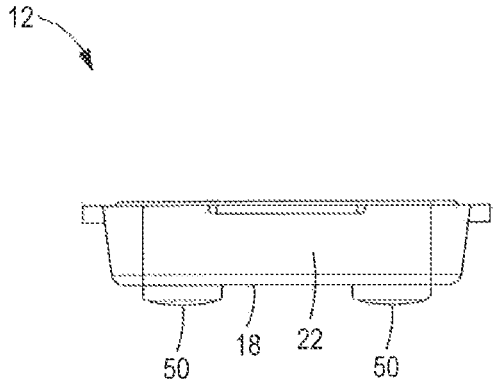
FIG. 4 is an end elevational view of the tray of FIG. 1.
Figure 5:
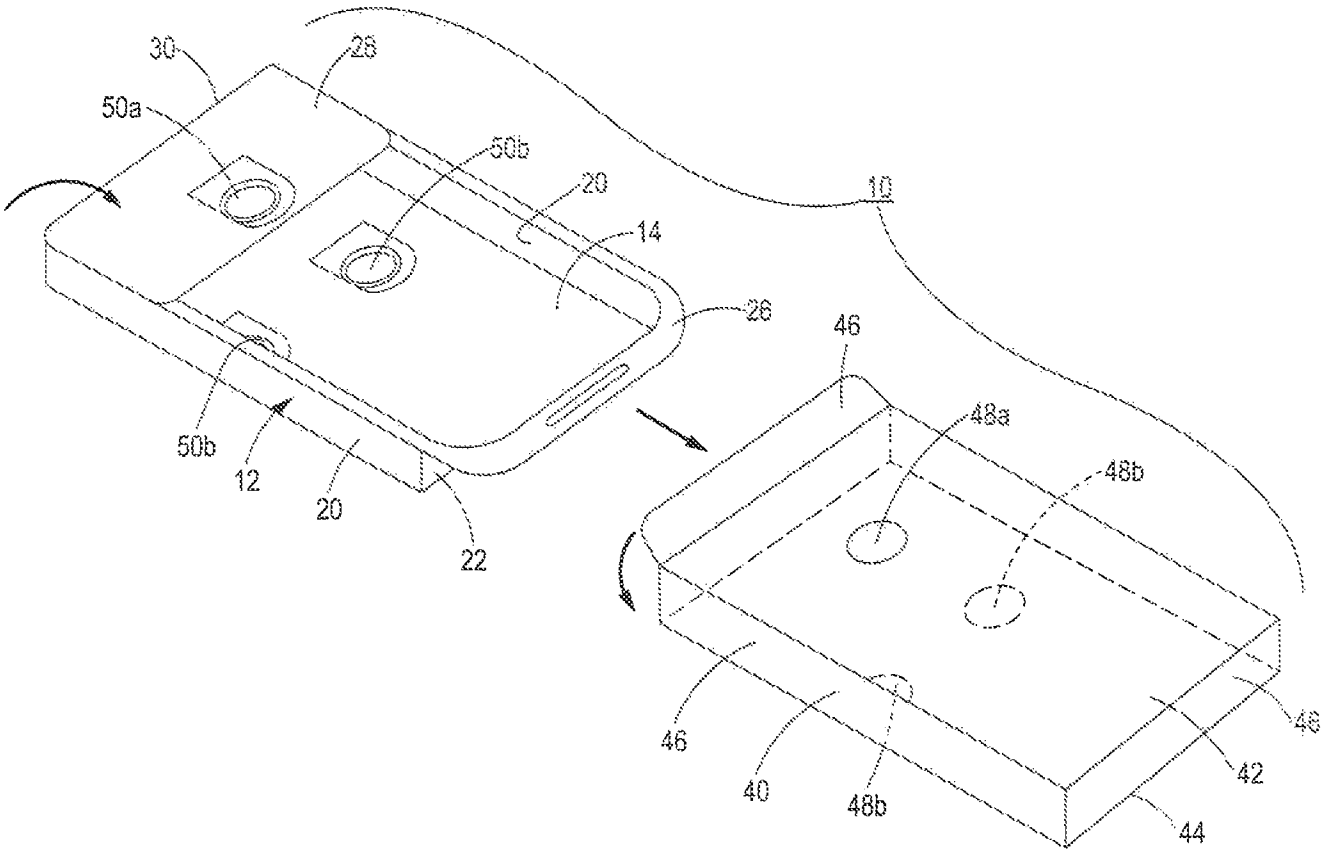
FIG. 5 is an exploded perspective view of a container according to the present disclosure.

While this disclosure may be embodied in many forms, there is shown in the drawings and will herein be described in detail one or more embodiments with the understanding that this disclosure is to be considered an exemplification of the principles of the disclosure and is not intended to limit the disclosure to the illustrated embodiments.

The present disclosure relates to a novel child resistant container 10 having a three-point activator system. The container 10 comprises a tray 12, a carton 40 and three buttons 50 that must be depressed simultaneously to remove the tray 12 from the carton 40, thereby allowing access to the tray contents. The buttons 50 are positioned so as to require an adult hand to operate.

Referring to FIGS. 1-4, the tray 12 may comprises a compartment 14 and a flap 28 hingedly attached to the compartment 14. The compartment 14 defines a cavity 16 for holding contents. The compartment 14 comprises a bottom wall 18, compartment sidewalls 20 and end walls 22. The compartment sidewalls 20 and the end walls 22 extend upward from the bottom wall 18 and terminate at a rim 24. The tray 12 further comprises a flange 26 extending outwardly from the rim 24. The flange 26 may define a slot or other opening 32, preferable opposite the flap 28, for accommodating a display hook.

The flap 28 may be attached to the compartment 14 along a hinge 30 so that the flap 28 can be rotated 180 degrees from the position shown in FIG. 1.

The container 10 may comprise two or more and preferably three resilient buttons 50 disposed on the tray 12. The buttons 50 are biased outwardly so that, in the assembled container 10, they extend through openings in the carton 40 to lock the tray 12 inside the carton 40 and secure the container 10 in a closed position. In addition, the hinge 30 preferably is a living hinge that biases the flap in the "open" position shown in FIGS. 1-3. The tray 12 may be sealed with a flexible film (not shown).

The carton 40 is configured to receive the tray 12 in secure, child proof fashion as explained below. The carton 40 may comprise a front or top wall 42, a back 44 and carton sidewalls 46. The front wall 42 and the back wall 44 should define openings 48 with locations corresponding to the buttons 50 in the assembled container 10. The resilient buttons 50 should project slightly above the front wall 42 and the back wall 44 to lock the tray 12 within the carton 40.

To open the container 10 and access the contents of the tray 12, all three buttons 50 must be depressed simultaneously by a (preferably adult) user so that the tray 12 can be withdrawn from the carton 40.

The buttons 50 should be positioned on the tray 12 to make it difficult to be simultaneously activated by a child. For example, in one aspect a first button 50*a* is located on the flap 28 so that, when the flap 28 is rotated so that it is in flat facing abutment with the compartment flange 26 and the tray 12 inserted into the carton 40, the first button 50 extends through an opening 48*a* on the top wall 42 of the carton 40. Second and third buttons 50*b* are located on the bottom wall 18 so that, when the tray 12 is inserted into the carton 40, the second and third buttons 50*b* extend through openings 48*b* on a bottom surface of the carton 40. Unless all three buttons 50 are simultaneously activated (such as by being depressed) by a user, the tray 12 cannot be withdrawn from the carton 40 and the container 10 remains closed.

The number of buttons may be two or more and preferably three. The buttons may be located on any suitable side or surface of the tray with the openings in the carton located in similar corresponding locations.

It is understood that the embodiments of the disclosure described above are only particular examples which serve to illustrate the principles of the disclosure. Modifications and alternative embodiments of the disclosure are contemplated which do not depart from the scope of the disclosure as defined by the foregoing teachings and appended claims. It is intended that the claims cover all such modifications and alternative embodiments that fall within their scope.

The invention claimed is:

1. A container comprising:

a tray comprising a compartment defining a cavity for holding one or more articles, the compartment comprising sidewalls and end walls extending upward from a bottom wall and terminating at a rim, the tray further comprising a flange extending outwardly from the rim and a flap attached to the flange along a living hinge, the tray further comprising a first resilient flap button disposed on the flap and a first resilient bottom button disposed on the bottom wall; and a carton configured to receive the tray, the carton comprising a front wall that defines a first front wall opening for accommodating the first resilient flap button, a back wall that defines a first back wall opening for accommodating the first resilient bottom button, and carton sidewalls; wherein the buttons are biased outwardly so that, when the container is in a closed position, each button extends through one of the openings in the carton.

2. The container of claim 1 wherein:

the container may be opened only by depressing all of the buttons simultaneously.

3. The container of claim 2 wherein:

the tray further comprises a second resilient bottom button disposed on the bottom wall; and the back wall further defines a second back wall opening for accommodating the second resilient bottom button.

4. The container of claim 3 wherein:

the number of buttons is three.

5. The container of claim 4 wherein:

when the container is in a closed position, the flap is in flat facing abutment with the flange.

6. The container of claim 1 wherein:

the flange defines a flange opening for accommodating a display hook.

7. The container of claim 6 wherein:

the flange opening is located opposite the flap.

8. The container of claim 1 wherein:

the flap is rotatable from a closed position in which the flap is in flat facing abutment with the flange to an open position in which the flap is not in flat facing abutment with the flange.

9. The container of claim 8 wherein, when the carton is in the closed position:

the first resilient flap button extends through the first front wall opening;

the first resilient bottom button extends through the first back wall opening; and a second resilient bottom button disposed on the bottom wall extends through a second back wall opening defined in the back wall.

10. The container of claim 8 wherein:

the flap is rotatable 180 degrees.

11. A container comprising:

a tray comprising a compartment defining a cavity for holding one or more articles, the compartment comprising sidewalls and end walls extending upward from a bottom wall and terminating at a rim, the tray further comprising a flange extending outwardly from the rim and a flap attached to the flange along a living hinge, the tray further comprising a resilient flap button disposed on the flap and a resilient sidewall button disposed on one of the sidewalls; and a carton configured to receive the tray, the carton comprising a front wall that defines a first front wall opening for accommodating the resilient flap button, a back wall and a carton sidewall that defines a carton sidewall opening for accommodating the resilient sidewall button; wherein the buttons are biased outwardly so that, when the container is in a closed position, each button extends through one of the openings in the carton.

12. A container comprising:

a tray comprising a compartment defining a cavity for holding one or more articles, the compartment comprising sidewalls and end walls extending upward from a bottom wall and terminating at a rim, the tray further comprising a flap attached to the compartment along a living hinge, the tray further comprising a resilient sidewall button disposed on one of the sidewalls and a first resilient bottom button disposed on the bottom wall; and a carton configured to receive the tray, the carton comprising a front wall, a carton sidewall that defines a carton sidewall opening for accommodating the resilient sidewall button, and a back wall that defines a first back wall opening for accommodating the first resilient bottom button; wherein the buttons are biased outwardly so that, when the container is in a closed position, each button extends through one of the openings in the carton.

13. The container of claim 12 wherein:

the tray further comprises a second resilient bottom button disposed on the bottom wall; and the back wall further defines a second back wall opening for accommodating the second resilient bottom button.

14. The container of claim 13 wherein:

the container remains in the closed position unless all of the buttons are simultaneously depressed by a user.

15. The container of claim 14 further comprising:

a flange extending outwardly from the rim; wherein the flap is attached to the flange along a living hinge.

16. The container of claim 15 wherein:

the flap is rotatable from a closed position in which the flap is not in flat facing abutment with the flange to an open position in which the flap is in flat facing abutment with the flange.

17. The container of claim 16 wherein, when the flap is in the closed position:

the resilient sidewall button extends through the carton sidewall opening; and the first resilient bottom button extends through the first back wall opening.

18. The container of claim 17 wherein:

the flap is rotatable 180 degrees.

* * * * *